US005694800A

United States Patent [19]

Lopez

[11] Patent Number: 5,694,800

[45] Date of Patent: Dec. 9, 1997

[54] PERFECTED COUNTERDIE FOR PIPE BENDING MACHINES

[75] Inventor: Manuel Lopez, Pamplona, Spain

[73] Assignee: Ineco Industrial Navarra de Equipos y Comercio, S.A., Spain

[21] Appl. No.: 561,263

[22] Filed: Nov. 21, 1995

[30] Foreign Application Priority Data

Jan. 26, 1995 [ES] Spain ..... U-9500230
Oct. 3, 1995 [ES] Spain ..... U-9502530

[51] Int. Cl.[6] ..... B21D 7/04; B21D 9/05

[52] U.S. Cl. ..... 72/149; 72/159

[58] Field of Search ..... 72/149, 150, 152, 72/154, 159, 369, 158

[56] References Cited

U.S. PATENT DOCUMENTS 2,955,638 10/1960 Hellwig .
3,921,424 11/1975 Pearson .
4,085,492 4/1978 Stange .
4,130,004 12/1978 Eaton .
4,355,528 10/1982 Rothenberger .
4,532,787 8/1985 Caporusso et al. .
4,765,168 8/1988 Stange et al. .
5,127,248 7/1992 Sanseau et al. .
5,345,802 9/1994 Caporusso et al. .
5,469,728 11/1995 Caporusso et al. ..... 72/154

FOREIGN PATENT DOCUMENTS 530611 8/1954 Belgium .
2501545 9/1982 France .

*Primary Examiner*—Lowell A. Larson
*Assistant Examiner*—Rodney Butler
*Attorney, Agent, or Firm*—Bierman, Muserlain and Lucas

[57] ABSTRACT

Improved counterdie for pipe bending machines, that has an approximately semicylindrical configuration in the working zone, with its frontal walls in a progressive ramp that becomes more pronounced in the vicinity of the exit zone, and provided with a longitudinal neck that is semicylindrical after the entrance zone, and then later truncated cone-shaped up to the exit zone, and with a longitudinal depression at the bottom with progressive section.

7 Claims, 2 Drawing Sheets

PERFECTED COUNTERDIE FOR PIPE BENDING MACHINES

This invention involves some improvements in pipe machines, specifically some improvements in the counterdie of a pipe bending machine.

All pipe bending machines, regardless their more or less complex structure (which depends on their use for bending different sizes of pipes), have a die and a counterdie which, when their necks coincide, encompass the pipe to be bent in the bending zone.

A major problem that arises when trying to bend thin-walled and/or small diameter pipes is that undesired deformations can occur that may last for a long time or even permanently.

These and other problems that will be discussed later have been solved with the counterdie of this invention, which is especially suited to bending, without an interior mandrel pipes with a very radius of tight curvature, in such a way that the radius of curvature in the pipe axis makes it possible to attain up to 1.6 times the outside pipe diameter. In addition, the potential deformations of a circular pipe section in transition zone of the bend are minimized as much as possible, and the pipe section in the bent zone continues to be appreciably circular.

The basis for the invention consists of providing a depression at the bottom of the counterdie neck, the variable geometry of which conforms to the stresses of the counterdie on the pipe, allowing for optimum plastic expansion of the metallic pipe material.

To better understand the purpose of this invention, a preferred way of rutting it into practice is shown in the drawings which may be subject to accessory changes that do not distract from the basis thereof.

Figure 6:
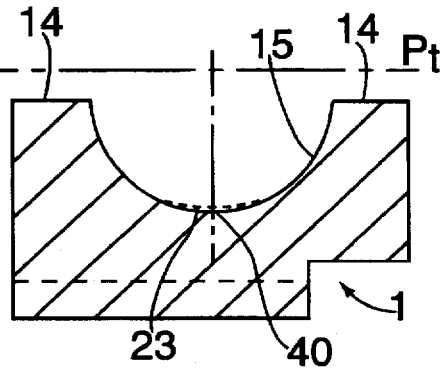
Figure 2:
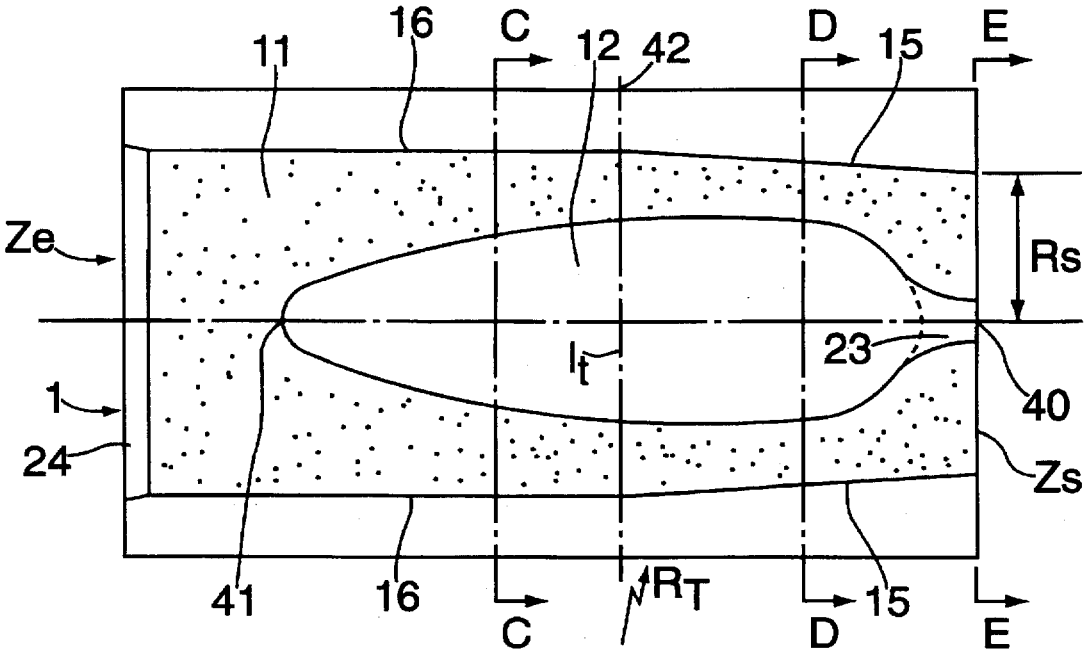
FIG. 2 shows a ground view of the counterdie illustrated in FIG. 1.

FIG. 6 cross section, as defined by E:E of FIG. 2.

The working zones of the counterdie (I) are shaped to approximate a semicylinder with:

- a neck (11), at the bottom of which a depression has been made (12), presenting a first semicircular zone (16) and a second truncated cone-shaped zone, so that the exit radius ($R_s$) is less than the entrance radius ($R_T$);
- frontal walls (13) in a progressive ramp with respect to the initial tangential plane ($P_t$) at the die (3) counterdie (1) meeting point.

Progressive Ramp

Figure 3:
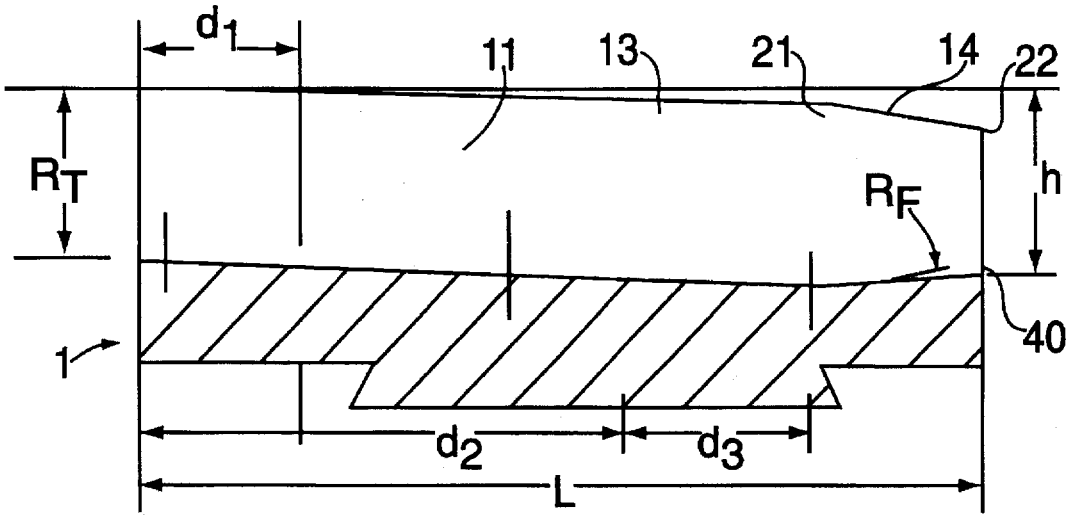
FIG. 3 shows a longitudinal section of FIG. 2.

The angle encompassed by the perimeter of the contact zone between the pipe (2) and the counterdie (1) is 180° at the pipe entrance zone (Ze) in the bending direction. This bending angle is slightly modified as we approach the opposite end where the bend is made. After a point (14) (FIG. 3), the contact angle decreases sharply up to point (22), which is the last contact point between the counterdie and the pipe.

The reason for this double ramp cross section is that the radius ($R_s$) of the counterdie in the last section is lets than the radius of the pipe ($R_T$) before it is bent, and as the counterdie mounted on its support approaches the beginning of the bend, it would strike the pipe and mark it and file counterdie would not be able to approach the correct initial bending position. This position requires that the counterdie lodge the pipe against the die, without any gap between them.

The improvement thus achieved with regard to before is that the pipe is at all times clasped by the counterdie while it is being deformed, and it is only released when the pipe fibers have acquired the sufficient deformation in the opposite direction of the pipe flattening.

Truncated cone section (15)

When the pipe is bent, it shifts from stretching and the pipe section (2) is decreased slightly, and therefore the neck (11) of the counterdie adapts to this situation.

The starting point (42) of this cone section is arranged in conjunction with the stress distribution and deformations caused by the depression (12) and, as shown in FIG. 2, it approaches the zone in which the transversal length ($l_t$) of the depression (12) is greatest.

Depression (12)

The applicant has experimentally studied the actions of the counterdie on the pipe walls, the tendency to flatten, deformations, and the fluidity of the pipe material and counterdie-pipe zones in which all of this occurs, and has concluded that the groove or depression (12) should be progressive on its transversal surface, fundamentally in width but also preferentially in depth.

The increased depression width (12) results in a progressive decrease of the pipe-counterdie contact zone (2) (1), allowing the excess material to flow through the depression (12) when the pipe is laterally compressed.

The depression (12) begins (41) approximately at a distance ($d_1$) from the entrance ($Z_e$) of approximately ¼ length (L) of the counterdie (1): $d_1 \simeq ¼$ L, beginning to increase in width and section.

Figure 1:
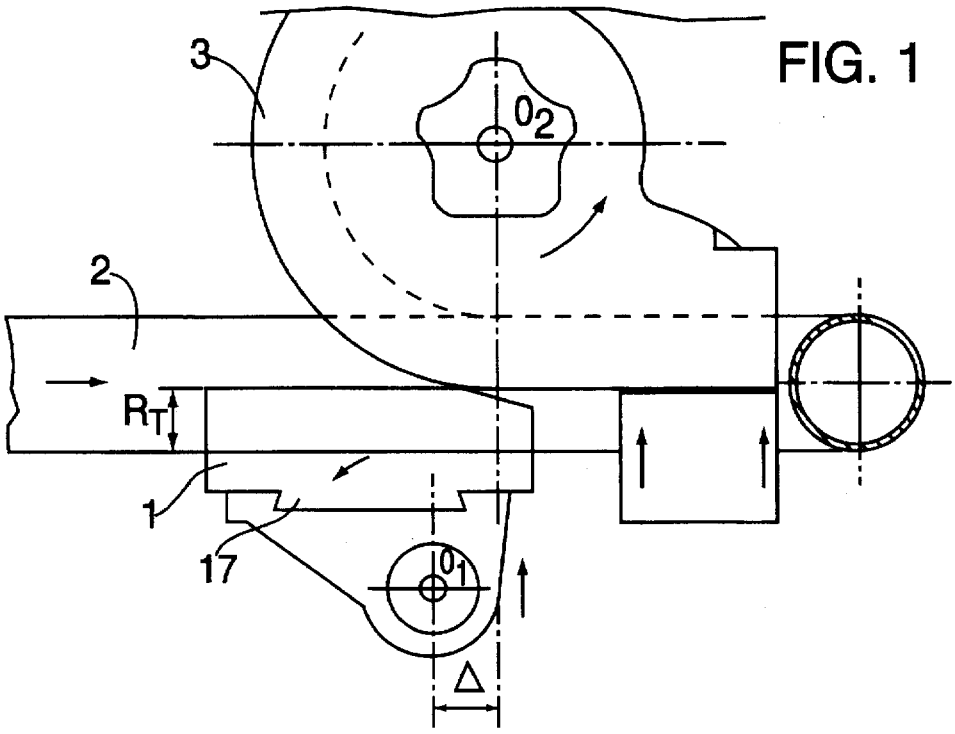
FIG. 1 shows an overall ground view of a pipe bending machine with the counterdie (1) covered, by the invention in operating position.
Figure 4:
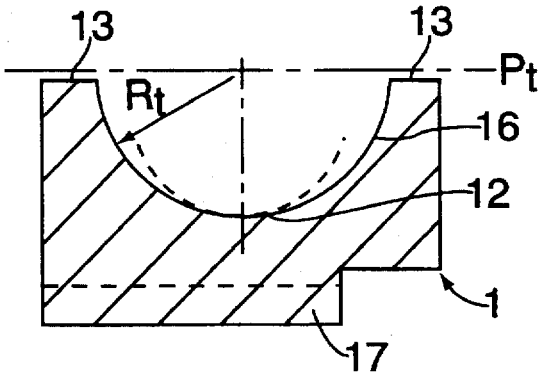
FIG. 4 shows a cross section, as defined by C:C of FIG. 2.
Figure 5:
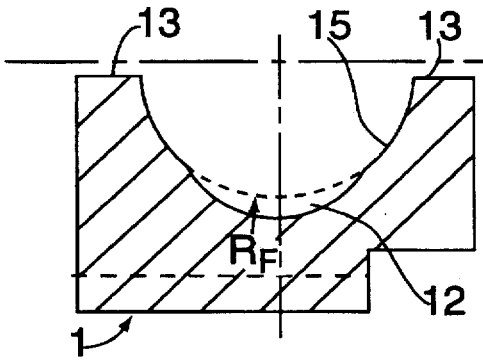
FIG. 5 shows a cross section, as defined by D:D of FIG. 2.

From the starting point (41), the depression clearly begins to increase in width (FIG. 2) and slightly in depth (FIG. 3) (FIG. 4), until it reaches a zone (42) in which the truncated cone section of the neck begins (11), where the width ($l_t$) approximately reaches a maximum value.

The starting point (42) of the truncated cone section is located at a distance ($d_2$) from the entrance ($Z_c$) that is greater than half the length (L) of the counterdie (1): $d_2 > ½$ L.

The maximum width ($l_t$) is approximately maintained for a distance ($d_3$) of approximately ¼ the length (L) of the counterdie (1): $d_3 = ¼$ L. until it reaches a zone (21) where the depression section begins to rapidly decrease along with its width and depth, until the exit is reached with a small depression (23), so that the depth (h) from the initial tangential plane ($P_t$) to the lower point (40) of the exit ($Z_s$) is greater than the entrance radius or pipe radius ($R_T$): $h > R_T$.

In the transition zones, the intersections resulting from the incidence of this depression are smoothed to avoid edges or incisive lines that would mark the pipe. There is a smooth transition between the end of the depression zone (12) and the small depression (23) in the end zone, as this allows contact of the outside pipe fibers in this last shaping zone of the counterdie and recovery of the pipe shape along the lines where the tendency to flatten is most pronounced.

in the pipe entrance zone ($Z_e$), there is an entrance edge (24) with a radius that helps the pipe to slide in and become impregnated with the lubricant applied at this point of the counterdie, where it is stored due to its own viscosity. The lubricant is also applied in the depression zone before each bending operation.

In the assembly, the rotation axes ($\theta_1$), ($\theta_2$), corresponding respectively to the counterdie (1) and the die (3), are out of step with each other by a considerable margin (Δ)—of the order of 20/30 min.—to reduce stresses in bending operations, using, for example, a dovetail (17) for anchoring the counterdie (1) in the carrier medium (m) of the rotation axis ($\theta_1$) on which it turns.

The depression can be made, for example, by a variable in-depth milling ($R_F$).

I claim:

1. Improved counterdie for pipe pending machines having an entrance zone and an exit zone and which has a semicylinder portion having an approximately semi cyclindrical configuration in its work zone with a longitudinal neck, characterized by the fact that the neck has an extended configuration with a progressive width between a minimum located toward the entrance zone, a maximum located toward the exit zone of the counterdie and wherein the counterdie has a bottom and:

a) the semicylinder has frontal walls and the frontal walls of the semicylinder form a progressive ramp from the vicinity of the entrance zone that becomes more pronounced in the vicinity of the exit zone; and b) the neck comprising:

$b_1$) a semicylindrical part after the entrance zone, which connects to a truncated cone-shaped part that ends in the exit zone, and $b_2$) a longitudinal depression on the bottom that extends to the exit zone and that has a progressive section that increases first and eventually decreases in both width and depth.

2. Improved counterdie for pipe bending machines, in accordance with claim 1, characterized by the fact that the depression approximately begins at a distance ($d_1$) from the entrance zone ($Z_e$) of approximately ¼ of the length (L) of the counterdie: $d_1$¼ L, and a section of the depression progressively increases in width until it reaches a junction zone of the semicylindrical part and the truncated cone-shaped part of the neck, after which the width is approximately maintained and decreases toward the end.

3. Improved counterdie for pipe bending machines, in accordance with claim 1, characterized by the fact that the depth (h) of the bottom of the exit zone is greater than the entrance radius ($R_T$) h $R_T$.

4. Improved counterdie for pipe bending machines, in accordance with claim 1, characterized by the fact that this die is mounted in a pivot manner around a rotation axis that is considerably out of step with regard to the rotation axis of the die, in order to reduce stresses on the bending operations.

5. Improved counterdie for pipe bending machines, in accordance with claim 1, characterized by the fact that the entrance zone has an edge and a countersink is provided at the edge of the entrance zone.

6. Improved counterdie for pipe bending machines, in accordance with claim 2, characterized by the fact that the depth of the depression increases and decreases approximately with its width.

7. Improved counterdie for pipe bending machines, in accordance with claim 2, characterized by the fact that the width of the depression is approximately maintained at its maximum value for a distance ($d_3$) similar to ¼ of the length (L) of the counterdie: $d_3 \simeq$ ¼ L.

* * * * *

UNITED STATES PATENT AND TRADEMARK OFFICE

CERTIFICATE OF CORRECTION

PATENT NO. : 5,694,800

DATED : December 9, 1997

INVENTOR(S) : Manuel Lopez

It is certified that error appears in the above-indentified patent and that said Letters Patent is hereby corrected as shown below:

Column 1, line 7, after "regardless" insert --of--; line 19, after "mandrel", insert --,--; line 19, change "radius of tight curvature" to --tight radius of curvature--; line 23, after "in" insert --the--; line 32, change "rutting" to --putting--; line 36, after "covered" delete ","; line 45, after "Fig. 6" insert --shows a--; line 46 change "(I)" to --(l)--; line 67, change "lets" to --less--.

Column 2, line 3, change "file" to --the--; line 37, change "($Z_{,e}$)" to --($Z_e$)--; line 46, change "($Z_c$)" to --($Z_e$)--; line 66, change "in" to --In--.

Column 3, line 8, change "min." to --mm.--; line 15 (claim 1) change "pending" to --bending--.

Column 4, line 7 (claim 2), change $d_1$1/4 L" to --$d_1 \simeq$1/4 L--; line 14 (claim 3), change "h $R_T$" to read –,h>$R_T$–.

Signed and Sealed this

Twenty-sixth Day of May, 1998

*Attest:*

*Attesting Officer*

Bruce Lehman

BRUCE LEHMAN

*Commissioner of Patents and Trademarks*